US010898930B1

(12) United States Patent
Garcia

(10) Patent No.: US 10,898,930 B1
(45) Date of Patent: Jan. 26, 2021

(54) CLEANING TOOL WITH RESERVOIR

(71) Applicant: Jay Aurelios Garcia, Carpentersville, IL (US)

(72) Inventor: Jay Aurelios Garcia, Carpentersville, IL (US)

( * ) Notice: Subject to any disclaimer, the term of this patent is extended or adjusted under 35 U.S.C. 154(b) by 192 days.

(21) Appl. No.: 16/010,456

(22) Filed: Jun. 16, 2018

(51) Int. Cl.

| | |
|---|---|
| ***B08B 1/00*** | (2006.01) |
| ***A46B 11/00*** | (2006.01) |
| ***A46B 9/02*** | (2006.01) |
| ***B08B 3/08*** | (2006.01) |
| ***A47L 13/16*** | (2006.01) |

(52) U.S. Cl.
CPC ..... *B08B 1/002* (2013.01); *A46B 9/02* (2013.01); *A46B 11/0006* (2013.01); *A47L 13/16* (2013.01); *B08B 3/08* (2013.01); *A46B 2200/3093* (2013.01)

(58) Field of Classification Search
CPC ..... B08B 3/08; A46B 11/0006
See application file for complete search history.

(56) References Cited

U.S. PATENT DOCUMENTS

| | | | | |
|---|---|---|---|---|
| 2,630,594 A | | 2/1947 | Fisher | |
| 2,990,564 A | | 7/1961 | Sweeney | |
| 3,113,335 A | | 12/1963 | Baicker | |
| 4,944,623 A | * | 7/1990 | McNeil | A47L 1/08 15/220.1 |
| 5,114,255 A | * | 5/1992 | Villarreal | A47L 13/26 15/230.16 |
| 6,216,306 B1 | | 4/2001 | Esterson | |
| 6,276,023 B1 | | 8/2001 | Grundy | |
| 6,425,701 B1 | | 7/2002 | Jacobs | |
| 6,443,646 B1 | * | 9/2002 | MacDonald | A46B 11/00 401/25 |
| D567,511 S | | 4/2008 | Borovicka | |
| 7,543,352 B2 | | 6/2009 | Schaaf | |
| 7,632,033 B2 | | 12/2009 | Wales | |

(Continued)

OTHER PUBLICATIONS

Safety Data Sheet: Simple Green® Heavy Duty BBQ & Grill Cleaner Version No. 60034-15A Issue Date: Mar. 31, 2015.

(Continued)

*Primary Examiner* — J C Jacyna
(74) *Attorney, Agent, or Firm* — Patentsand Licensing LLC; Daniel W. Juffernbruch

(57) ABSTRACT

A cleaning tool with a reservoir is configured with an elongated handle attached to a brush head. A knob is affixed to the center of the brush head. A reservoir has an integrated brush head and hollow handle, allowing fluid to enter the cavity of the brush head where a the absorptive material intermediately disposed between the reservoir and the heat tolerant liquid permeable material to hold and transport the cleaning liquid from the reservoir to the heat tolerant liquid permeable material. The intermediate material referred to as a squeeze sponge wicks fluid from the reservoir when a user applies force on the handle or knob and distributes the fluid. The brush head is assembled with a valve and compression spring used to regulate flow of fluid within orifices communicated between the integrated reservoir, intermediate sponge layer and valve mechanism. The cleaning tool can accommodate independent interchangeable scrubbing brushes.

20 Claims, 13 Drawing Sheets

(56) References Cited

U.S. PATENT DOCUMENTS

| | | | | |
|---|---|---|---|---|
| 8,099,822 | B2 | 1/2012 | Dale | |
| 8,672,572 | B1 | 3/2014 | Almada | |
| 9,101,205 | B2 | 8/2015 | Brushtech | |
| 9,675,209 | B2 | 6/2017 | Roth | |
| 2002/0106478 | A1* | 8/2002 | Hayase | D04H 1/732 428/91 |
| 2004/0010571 | A1 | 1/2004 | Hutchinson et al. | |
| 2004/0058839 | A1 | 3/2004 | Tadrowski | |
| 2004/0093679 | A1* | 5/2004 | Kukoff | A47L 13/16 15/118 |
| 2004/0228670 | A1* | 11/2004 | Colburn | A46B 11/06 401/11 |
| 2004/0265042 | A1* | 12/2004 | Chan | A47L 17/04 401/270 |
| 2005/0008675 | A1 | 4/2005 | Giovanni | |
| 2005/0160544 | A1 | 7/2005 | Geller | |
| 2005/0207820 | A1 | 9/2005 | Franczak | |
| 2007/0270088 | A1* | 11/2007 | Greenwood | B24B 23/04 451/73 |
| 2009/0301520 | A1 | 12/2009 | Schaaf | |
| 2010/0006797 | A1 | 3/2010 | Hawkins | |
| 2010/0056413 | A1 | 3/2010 | Harry | |
| 2010/0152091 | A1 | 6/2010 | Malik | |
| 2011/0168206 | A1 | 7/2011 | Schaaf | |
| 2012/0063836 | A1* | 3/2012 | Gilbert | A47J 37/0786 401/261 |
| 2014/0056635 | A1* | 2/2014 | Almada | A47J 37/0786 401/205 |

OTHER PUBLICATIONS

Safety Data Sheet: Simple Green® Heavy-Duty BBQ & Grill Cleaner (aerosol) Version No. 60014-15A Issue Date: Mar. 19, 2015.

George Foreman Grill Sponge and package photographs 2017.

How to Clean a George Foreman Grill foremangrillrecipes.com 2017.

* cited by examiner

CLEANING TOOL WITH RESERVOIR

BACKGROUND OF THE INVENTION

1. Technical Field

The present inventions relate to cleaning tool and, more particularly, relate to a new cleaning tool for cleaning the grates of a grill while also applying a cleaning fluid.

2. Related Art

Conventional cleaning tools are typically made with metal bristles forming a planar abrasive surface. Conventional cleaning tools have been known to be ineffective in scrubbing a grilling surface while leaving bristles behind.

There exists a need for such a cleaning tool to be operated by hand and formed with a reservoir into which fluid can be properly filled.

There exists a need for such a cleaning tool to be used to regulate the fluid to effectively use the heat from the grill to generate steam for cleaning while grilling.

There exists a need for such a cleaning tool that is designed and formed to contour to the grates to effectively remove the residue and grease from the on top and side surfaces of the grate channels.

There exists a need for such a cleaning tool that uses the hot cooking surface while grilling to use the steam generated from water that easily removes of the residue and sanitizes the grill.

There exists a need for a cleaning tool that can supply a cleaning fluid to the brush when required and in a controlled and measured manner, thereby alleviating wasted fluid nor prematurely running out of fluid in the reservoir.

SUMMARY OF THE INVENTION

A cleaning tool with a reservoir constructed of: a brush with an elongated handle which is secured to the reservoir for scrubbing with the heat tolerant liquid permeable material when wet from the cleaning fluid dispensed from the reservoir; a heat tolerant liquid permeable material on an outside surface of the tool and secured beneath the reservoir to receive the cleaning liquid, the heat tolerant liquid permeable material capable of withstanding a temperature above 212 F (100 C); a knob affixed to the center of the brush, wherein the handle is a knob; a brush reservoir incorporated into the brush head and handle, allowing fluid to enter the cavity of the brush reservoir where a the absorptive material intermediately disposed between the reservoir and the heat tolerant liquid permeable material to hold and transport the cleaning liquid from the reservoir to the heat tolerant liquid permeable material. The intermediate layer in embodiments can be a compressible material. When the compressible material is a sponge, it can be referred to as a squeeze sponge. The compressible material or squeeze sponge provides a supply of fluid and wicks fluid from the reservoir when a user applies a downward force on the handle or the knob. The cleaning tool is manually operated with an integrated reservoir and uses the heat of the grill while grilling to generate steam from water in a way that eases the removal of residue from the cooking surface of the grill.

The disclosed invention may be embodied as a cleaning tool consisting of: a brush tube-handle reservoir attached to the end of the brush head; a knob affixed to the center of the brush head; a fluid reservoir located within the tube-handle and cavity of the brush head wherein the cleaning liquid held in the reservoir comprises a natural food grade cleaning acidic solution; a squeeze sponge located inside the cavity of the brush head; or a brush head without a handle member that extends outside the circumference of a removable tube-handle reservoir; a reservoir cap attached to the end of the brush handle; or a reservoir cap attached to the end of brush head opening where fluid enters the cavity, and a valve and compression spring mechanism located in the interior cavity of the brush head. The brush head is configured with removable scrubbing brushes includes: a heat tolerant wire comprises a plurality of rows of wire brushes with the rows arranged in parallel and spaced distances conforming to a cooking grate; and heat tolerant liquid permeable sponge comprises a closed cell sponge wherein the closed cell sponge liquid permeable channels therein for liquid permeability and comprises a grooved sponge on a lower side with rows of grooves arranged in parallel and spaced distances conforming to a cooking grate. Furthermore, the disclosed invention relates to a cleaning tool that is configured to synchronize a group of integrated components of a reservoir in harmony during operation: tube-handle, brush head, sponge and valve mechanism. As fluid enters the cavity of the of brush head, fluid is retained within the space of the cavity; and as the valve opens fluid is absorbed by a squeeze sponge. The reservoir and squeeze sponge provide a supply of fluid and releases fluid by a user applying downward force from the tube-handle reservoir or the knob. The valve remains closed at rest. The valve is activated during operation by a user pushing down on the knob or tube-handle reservoir and the valve opens and disburses the fluid to the squeeze sponge which wicks fluid drawn from the reservoir downstream onto the scrubbing brushes.

BRIEF DESCRIPTION OF THE DRAWINGS

The present disclosure will be better understood by those skilled in the pertinent art by referencing the accompanying drawings that are representative of a cleaning tool embodiment in accordance with the invention. The components in the drawings clearly illustrate the principles of the invention and are not necessarily displayed to scale. The corresponding components of the embodiment views are numerically numbered.

DETAILED DESCRIPTION OF THE PREFERRED EMBODIMENTS

Figure 1:
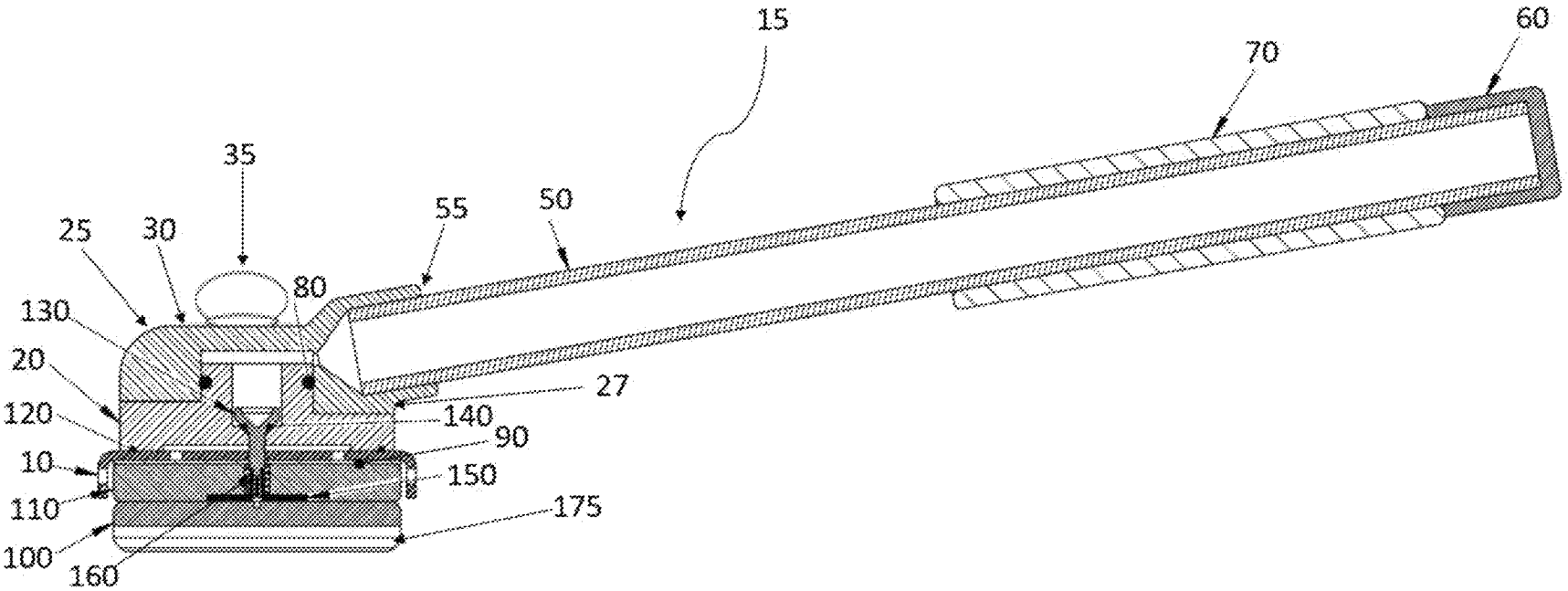
FIG. 1 is a side partial cross-sectional view of one embodiment of the disclosed cleaning tool.
Figure 2:
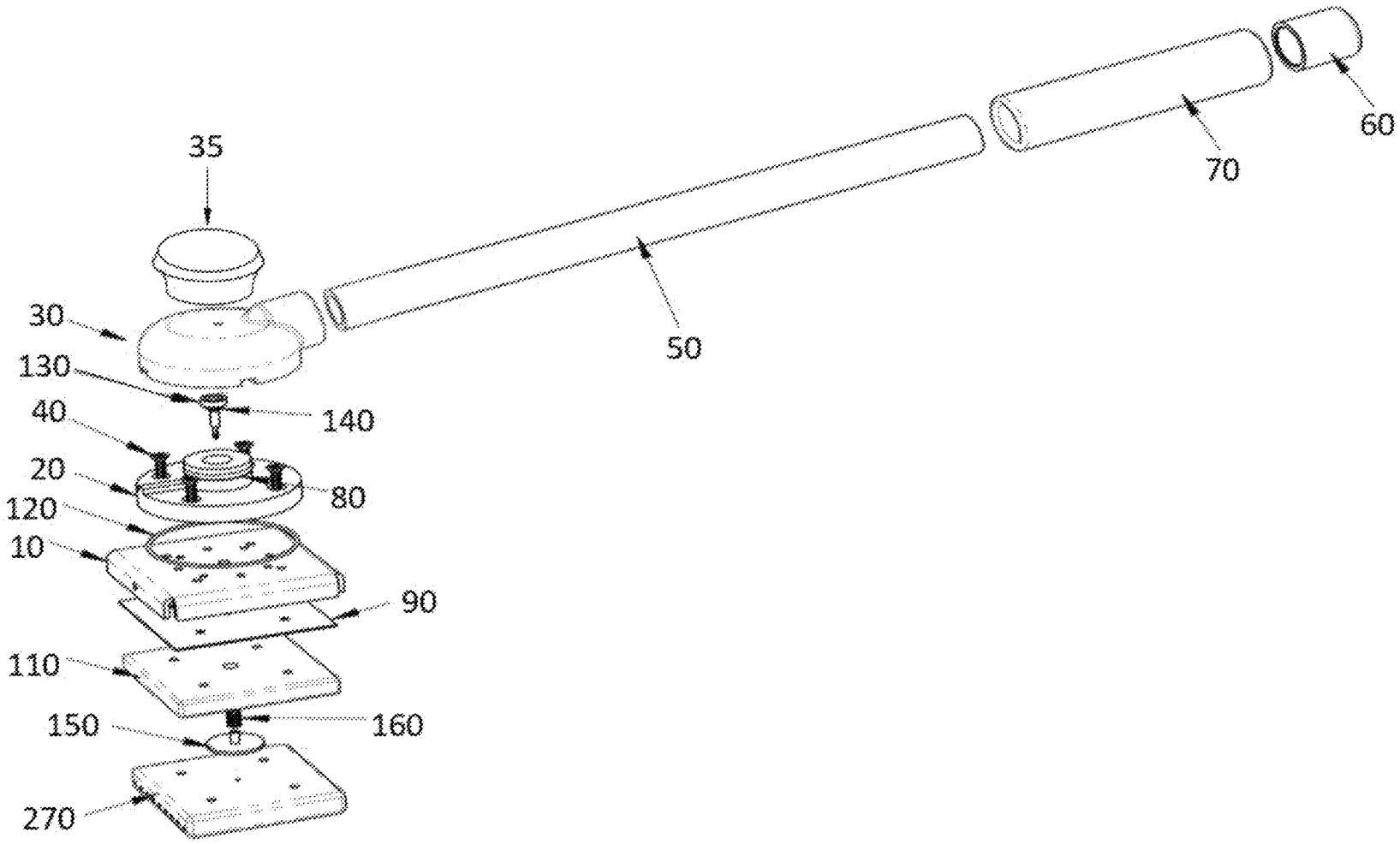
FIG. 2 is an exploded view of the cleaning tool from FIG. 1 showing the detail of the brush head including side view of the aluminum oxide sponge.
Figure 3:
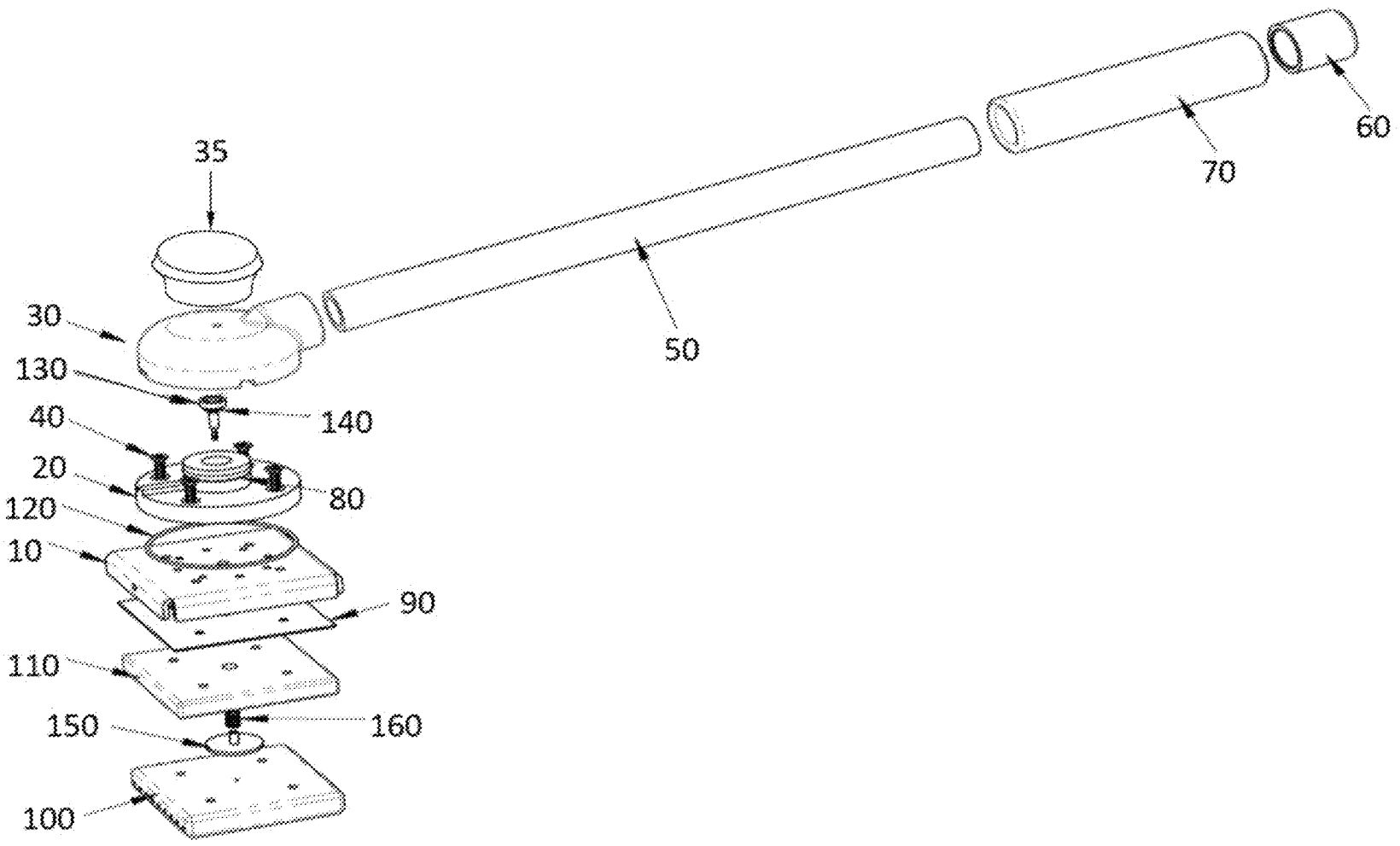
FIG. 3 is a partial cross-sectional view cleaning tool from FIG. 1 showing the detail of the brush head including side view of the silicone sponge.
Figure 4:
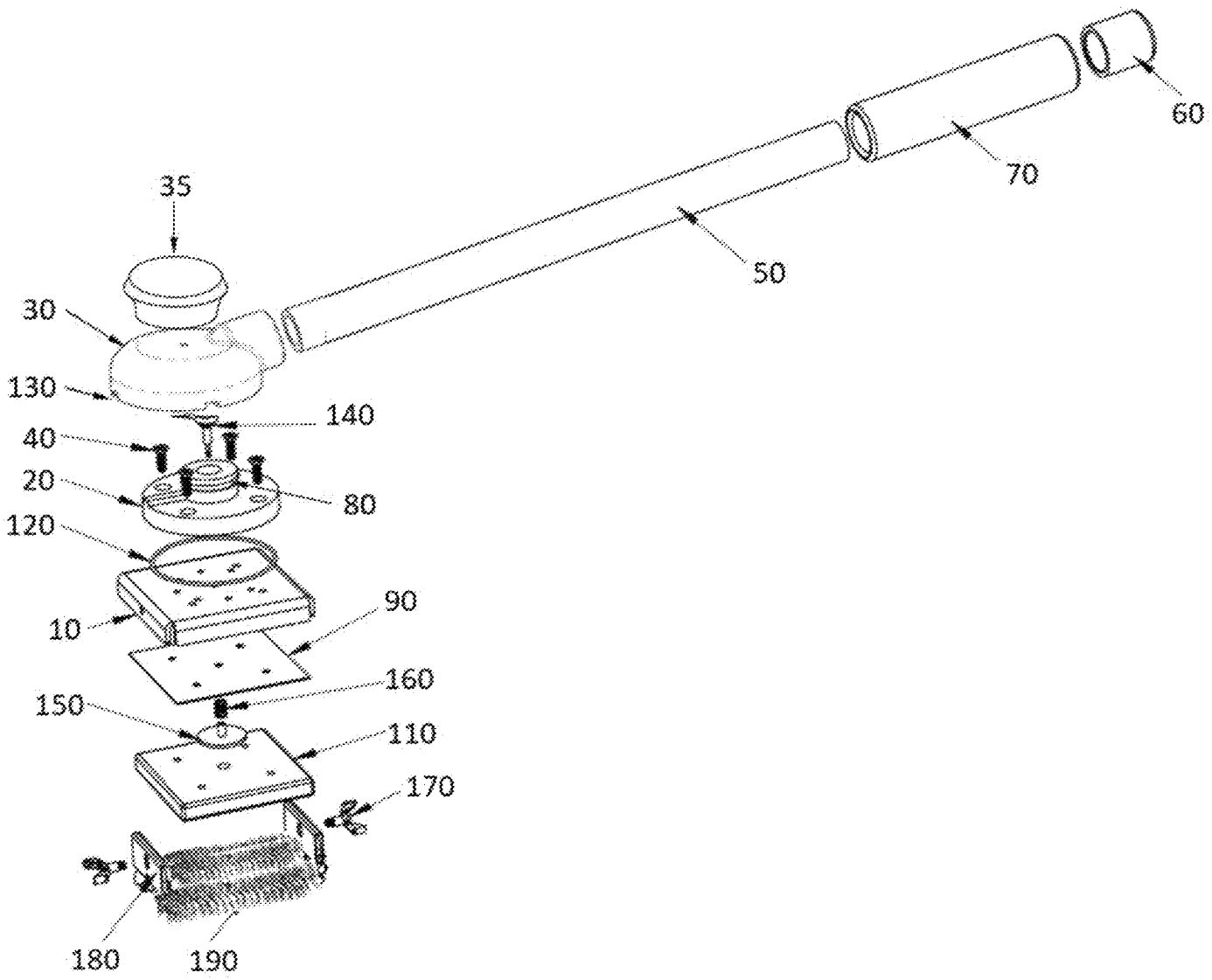
FIG. 4 is a partial cross-sectional view cleaning tool from FIG. 1 showing the detail of the brush head including side view of the bristle brushes.
Figure 5:
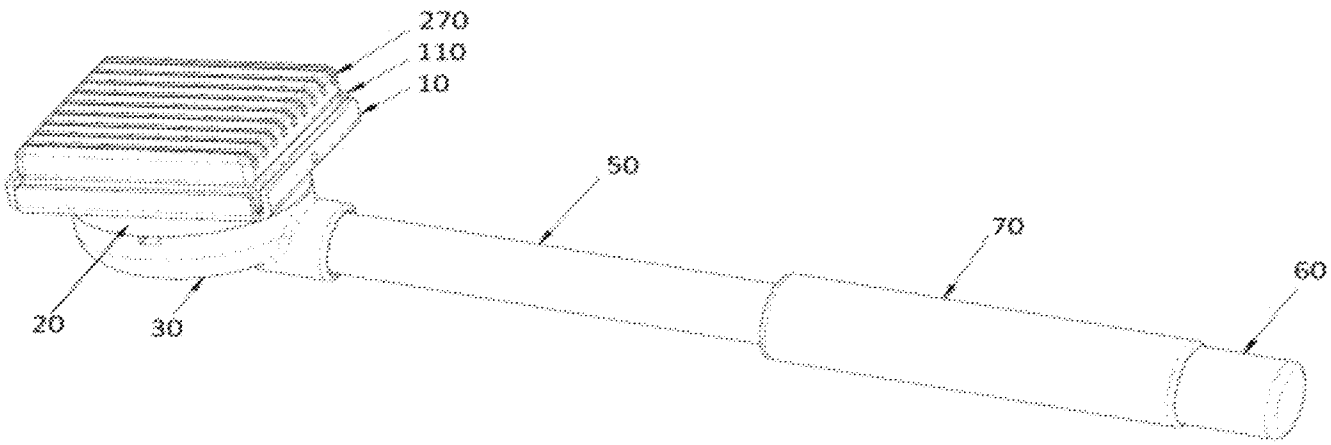
FIG. 5 is a front view of a brush head displaying the front side view of silicone sponge.
Figure 6:
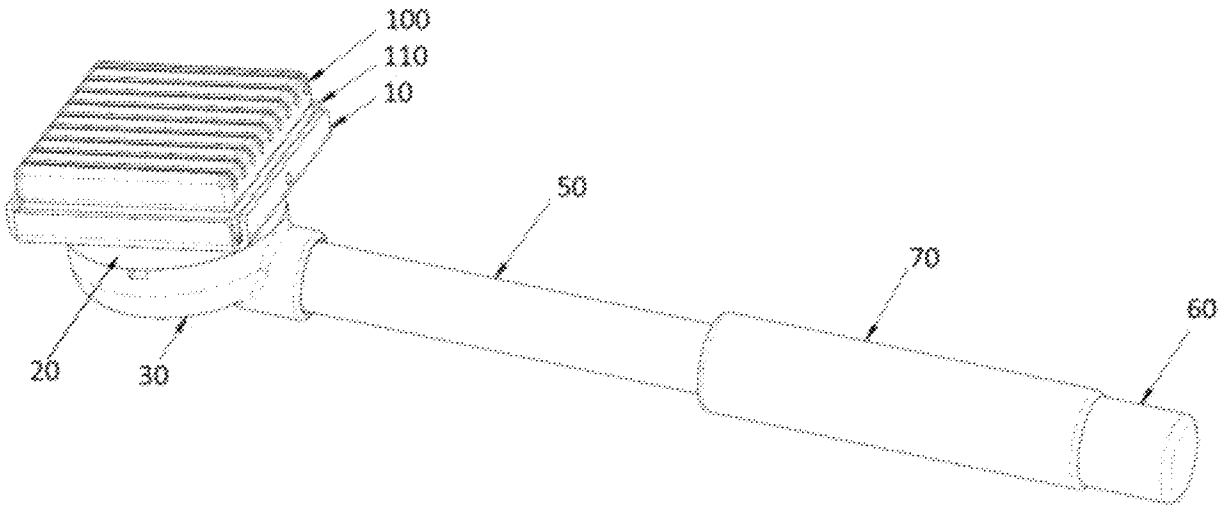
FIG. 6 is a front view of a brush head displaying the front side view of aluminum oxide sponge.
Figure 7:
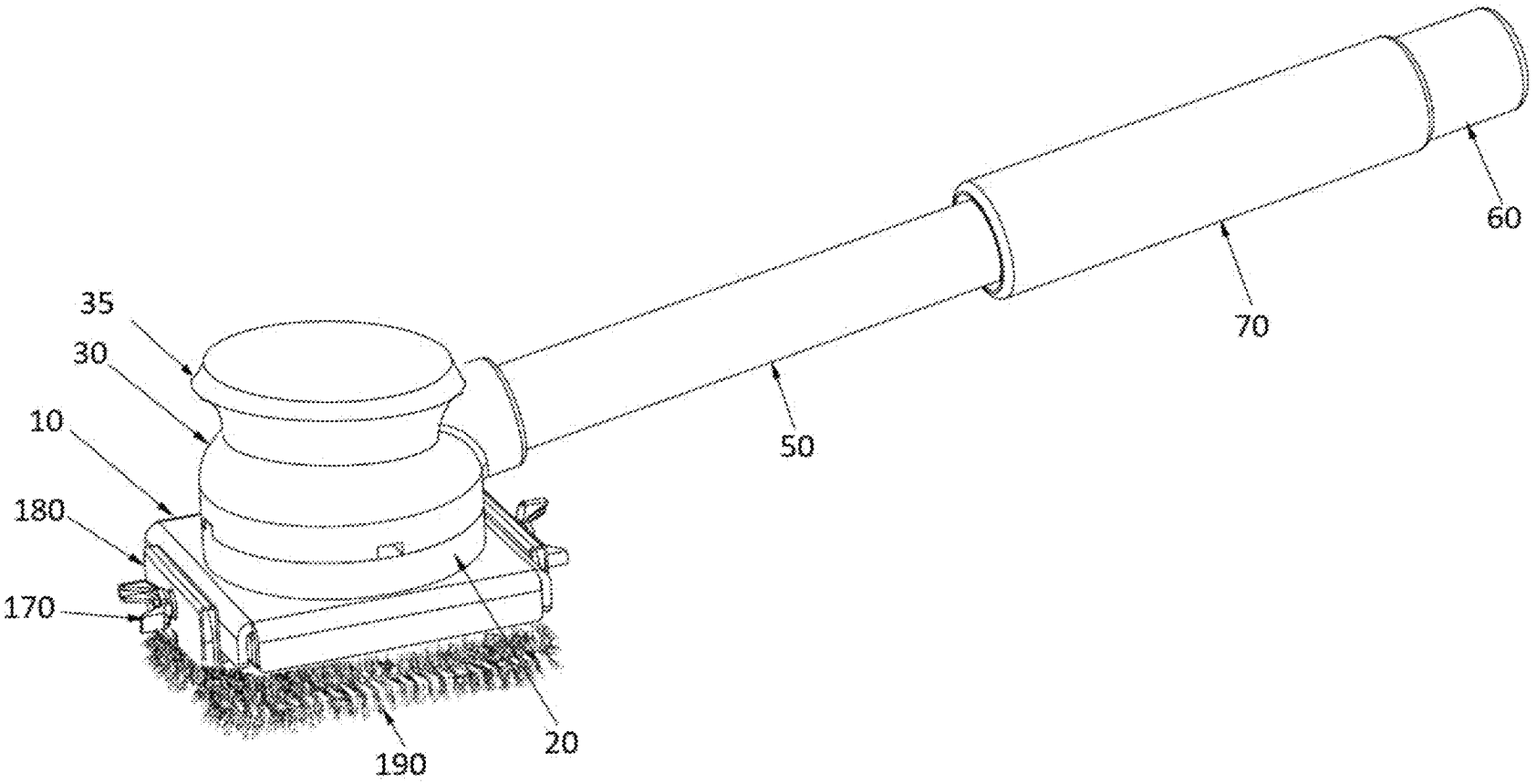
FIG. 7 is a front view of a brush head displaying the front side view of bristle brushes.
Figure 8:
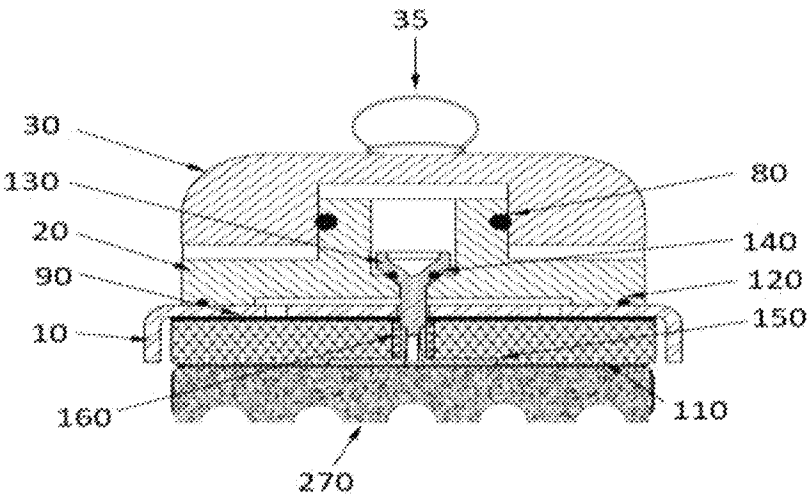
FIG. 8 is a front view of a brush head displaying the front side view of aluminum oxide sponge.
Figure 9:
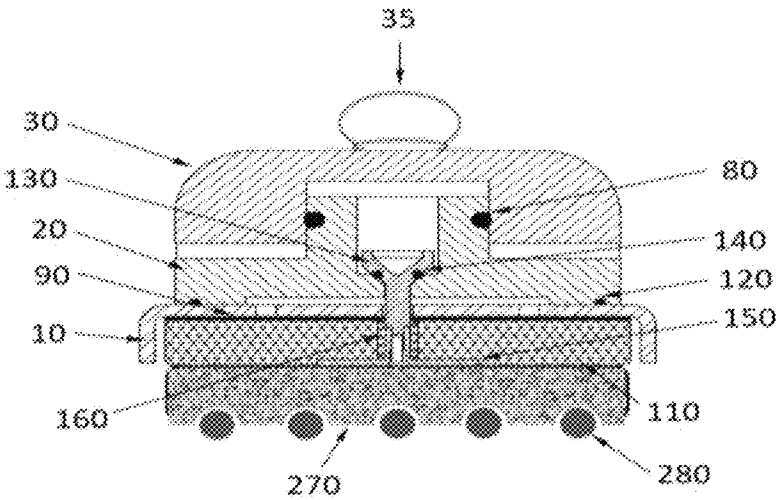
FIG. 9 is a front view of a brush head displaying the front side view of aluminum oxide sponge pressed against the grill grates.
Figure 10:
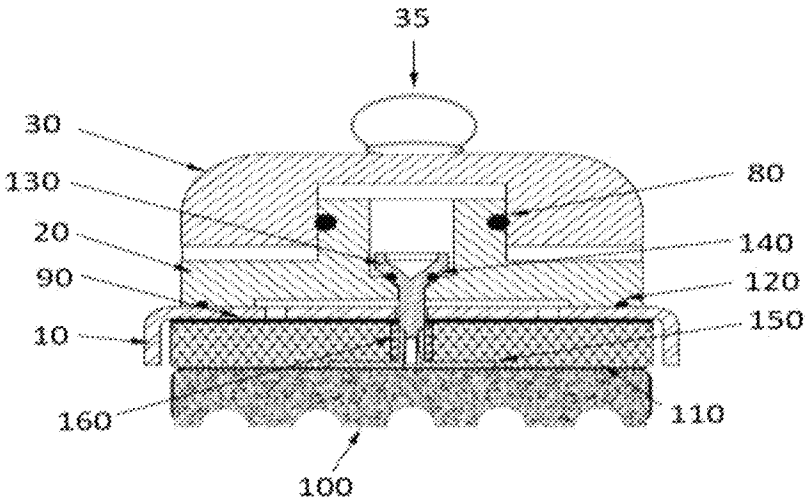
FIG. 10 is a front view of a head brush displaying the front side view of silicone sponge.
Figure 11:
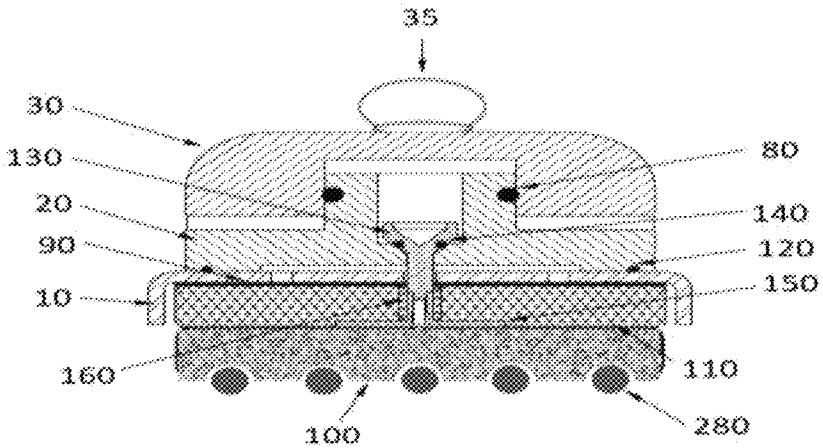
FIG. 11 is a front view of a head brush displaying the front side view of silicone sponge pressed against the grill grates.
Figure 12:
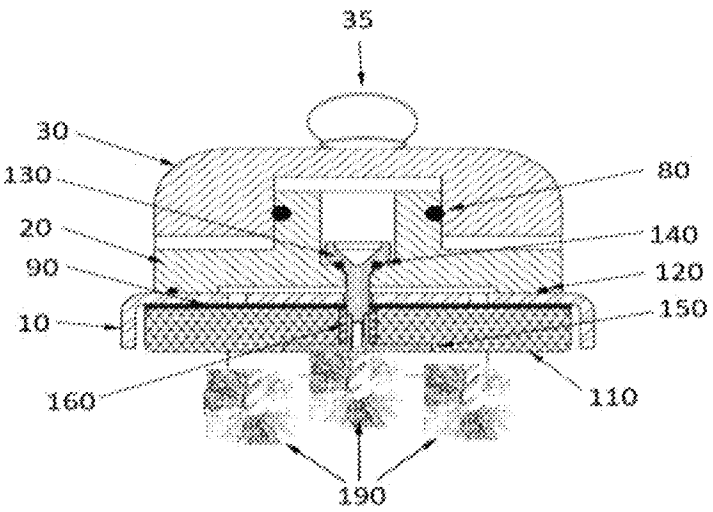
FIG. 12 is a front view of a head brush displaying the front side view of bristle brushes.
Figure 13:
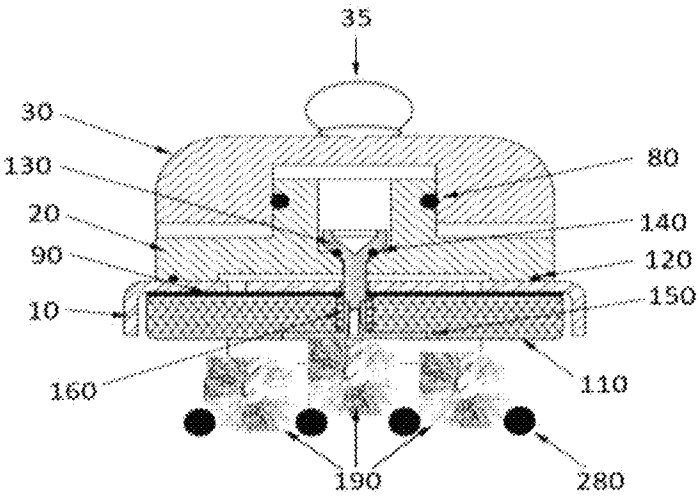
FIG. 13 is a front view of a head brush displaying the front side view of bristle brushes pressed against the grill grates.

The disclosed invention relates to a cleaning tool used for cleaning barbecue grill grates as per the invention shown in FIGS. 1 to 16. Such illustrations are meant to show the innovative ways of cleaning barbecue grill grates and are not intended to be restrictive to the invention.

Referring to FIGS. 1 to 16, cleaning tool 15 has a brush heal 25, a tube-handle reservoir 50, brush head reservoir 55, a knob 35 affixed to the center of the brush head 25; handle grip 70 and a reservoir cap 60. The reservoir cap 60 can have an optional pinhole opening through which air vents. The tube-handle reservoir 50 and scrubbing brush element are formed integrally within brush head 25. The tube-handle reservoir 50 has an elongate shape for grasping and is attached to the outer circumference projecting the end of the brush head 25 and contains an opening through which the fluid flows from the handle; and its detachable at the end of brush head 25 to form a cleaning tool 15 with no tube-handle reservoir 50 as shown in FIG. 15. The reservoir cap is attached to the end tube-handle reservoir 50; or the reservoir cap is attached to the end of brush head opening where fluid enters the brush head reservoir 55 as shown in shown in FIG. 15. During operation, the tube-handle reservoir 50 distributes fluid to a squeeze sponge which releases the fluid downstream to the scrubbing brushes 175. The scrubbing brush is attached to the bottom of the head brush 25 and is adoptable to different forms of scrubbing brushes 175 which includes abrasive bristle wires and abrasive scrubbing sponges.

The squeeze sponge 110 in various embodiments can be any highly absorptive compressible material such as a sponge. The squeeze sponge 110 is formed as part of the sponge assembly that includes the interfacing substrate 90, mounting plate 10 and is staggered below and attached to the mounting hub 20. The sponge assembly can be separated from upper hand hub 30 and handle assembly for: cleaning purposes and replacing sponge assembly by turning sponge assembly 90 degrees. The handle grip 70 can be inserted onto tube-handle reservoir 50 if the handle grip is made of foam, or the handle grip can be molded in place. The tube-handle reservoir 50 is attachable to the brush head 25 via threaded mating surfaces or welded, glued or press fit. The tube-handle reservoir 50 and brush head reservoir 55 is adapted to be filled with a liquid or water mixed with a powered citrus acid cleanser. The tube-handle reservoir 50 can be affixed to hand hub 30 through: ultrasonic welding, screwing in place, press-fit or gluing in place. An O-ring 80 both provides a seal between hand hub 30 and mounting hub 20 and holds mounting hub 20 into hand hub 30 by using a slight indentation on the inside wall of hand hub 30. Additional constraint can come from adding removable snap features as well. Mounting hub 20 is affixed to mounting plate 10 either by screws, rivet 40 or heat-staking; and mounting hub 20 is sealed to mounting plate 10 with either a separate or molded in O-ring 120.

The brush head 25 is constructed with a valve 130, compression spring 160 and lower valve actuator 150 mechanism. Plastic lower valve actuator 150 is snapped onto plastic valve 130 during assembly. Valve 130 is integrated with the compression spring 160 and lower valve actuator 150 within the brush head reservoir 55. When not activated, valve 130 is sealed to mounting hub 20 with either a separate or molded in O-ring 140. Compression spring 160 is captured between lower valve actuator 150 and mounting plate 10 and provides a resistance force required to hold valve 130 closed. When the brush head 25 is pushed down manually the compression spring 160 exerts a linear resistance force on the valve stem which triggers the valve actuator 150 to open the valve 130. When the valve 130 is at rest the spring 160 exerts a resistance force on the valve actuator 150 to close the valve 130. The compression spring exerts a bias force on the valve 130 to move vertically upward to open the valve 130 and vertically downward to close valve 130.

The brush head 25 is assembled with a valve 130 and compression spring 160 used to regulate the flow of fluid within the orifices communicated between the integrated reservoir, intermediate sponge layer 110 and valve mechanism. Fluid is regulated by the amount of pressure exerted on the valve 130 mechanism. The valve 130 remains closed at rest. The valve 130 is activated during operation by a user pushing down on the knob 35 or tube-handle reservoir 50 and the valve 130 opens and disburses the fluid to the squeeze sponge 110 which wicks fluid drawn from the reservoir downstream and disbursed onto the scrubbing brushes 175.

Holding the knob 35 while scrubbing the grate rods 280 gives the user the ability to press greater force on the cleaning tool 15. When the brush head 25 is pressed down from the knob 25 or tube-handle reservoir 25 during operation, the cleaning tool 15 flexes and compresses 68, the squeeze sponge 110, compression spring 160 and valve 130. The compression spring 160 bias forces the valve to open during operation and close when the valve is at rest. Fluid gradually stops flowing from the lower volume of cavity 27 as the linear bias force exerted on the hand hub 30 is relieved and brush head 25 decompresses the squeeze sponge 110 and compression spring 160 retracts the valve actuator 150 to close the valve 130. The downward force on the head brush 25 lifts the valve 130 to allow fluid to exit.

The brush head 25 is formed with a detachable squeeze sponge 110 producing a reservoir into which a liquid cleanser or water can be absorbed. The brush head reservoir 55 and squeeze sponge 110 are integrated components of a fluid reservoir and the squeeze sponge 110 is adopted as the intermediate layer to provide a supply of fluid and wicks fluid quickly by a user applying force from the tube-handle reservoir 50 or on the knob 35 located in the center of the brush-head. The squeeze sponge 110 can be affixed to mounting plate 10 through gluing or in-molding directly to mounting plate 10 or use of interfacing substrate 90 if required. The squeeze sponge 110 is made of an open cell polyvinyl alcohol material and is situated inside the cavity 27 of the brush-head 25 attached to the mounting plate 10 and interfacing substrate 90; and interfaces with the scrubbing brushes 175 located at the bottom end of the brush head. An open cell polyvinyl alcohol material is a PVA material.

The scrubbing brushes 175 are designed and formed to wrap around the accessible perimeter of grate rods 280 to effectively remove debris and baked-on food deposits. The cleaning tool 25 provides independent interchangeable brushes and are adoptable to different forms of scrubbing brushes 175 which include wire bristle brushes 190, silicone sponge 100 or an aluminum oxide sponge 270 as shown. Also an alternative, the sponge can be made of a nanofiber. The ceramic nanofiber can be capable of withstanding up to 1400 F. The aluminum oxide sponge can be capable of withstanding up to 5391 F (2977 C). The scrubbing brushes 175 are molded to easily attach and be removed from the head brush 25. Whatever material is chosen for the temperature liquid permeable material, it must be capable of withstanding a temperature above 212 F (100 C). The silicone sponge 100 or aluminum oxide sponge 270 are made of an impermeable material and pinholes are bored through to allow fluid to transport from the reservoir components downstream to the bottom layer scrubbing surface area during operation. The cleaning tool 15 uses the heat of the grill to generate steam from water in the liquid in a manner that eases the removal of residue.

Referring to FIGS. 4 and 7 and FIGS. 12 to 13 the bristle brushes 190 are welded to brush mounting brackets 180 and is made of a heat tolerant wire which includes a plurality of rows of wire brushes with the rows arranged in parallel and spaced distances conforming to a cooking grate. The bristle brushes consist of three woven stainless steel spiraled wire bristle formed in a triangular geometric shape and affixed to mounting plate 10 and fastened by the threaded mating surfaces of the wing nuts 170 and brush mounting brackets 180. Bristle brushes 190 and brush mounting bracket 180 sub-assembly are affixed to mounting plate 10 with two (or more) screws or wing nuts 170. A shoulder or spacer on the wing nut or screw 170, prevents screws or wing nuts 170 from clamping onto brush mounting brackets 180 and allows some limited vertical movement as well as side to side movement through the use of slots in the brush mounting brackets 180. This freedom of limited movement enables the brush to push against the lower valve actuator 150 and open the valve 130 thus applying more fluid as needed. Staggered placement of bristle brushes 190 allows cleaning with each stroke of the brush through added contact with both the top and sides of the grate rods 280. The wire bristles are woven around a metal rod, producing spiraled shaped bristles arising in 360 degrees configuration. The spiraled wire bristle brushes 190 have a triangular design to rotate around the grate rods 280 and provides deep cleaning under hot flames. The wire bristle brushes 190 can slightly shift upward and downward through the use of spacers on the nut or screw attachments 170W which pass through slots in the brush mounting bracket 180 in which the spacers ride in, allows the required movement to compress or decompress the squeezable sponge 110 and compressible spring 160 thus triggering the opening and closing the valve 130 within the cavity 27 of brush head 25.

Referring to FIGS. 2, 3, 5 and 6 and FIGS. 8 to 11 the cleaning tool includes a silicone sponge 100 or aluminum oxide sponge 270. Grooves on the underside of either silicone sponge 100, or aluminum oxide sponge 270 allows cleaning with each stroke of the brush through added contact with both the top and sides of the grate 280. The grooved surface silicone sponge 100 or aluminum oxide sponge 270. The silicone sponge 100 is bristle-free and safest way to rinse and clean the grate 280, avoiding the danger of metal bristles that could fall out and get into the food. The silicone sponge 100 will not cause scratches on the grill or lift the cure from the grate; and prevent small, sharp bristles that can break off during cleaning and get stuck to the grill's cooking surface.

Referring to FIGS. 3, 6, 10 and 11, respectively the cleaning tool includes a silicone sponge 100, wherein the heat tolerant liquid permeable sponge comprises a closed cell sponge; wherein each of the grooves in the grooved sponge comprise wrap around grooves for wrapping onto a top and sides of a corresponding bar of the cooking grate 280; and wherein the closed cell sponge include liquid permeable channels therein for liquid permeability. The grooved shape sponge is designed to promote effective rinsing as well as removal of remaining deposits from grate 280. Silicone sponge 100 is non-water absorbent, porous and bacteria and mildew resistant. Silicone can be used safely on hot grill tops without scratching or lifting the grill cure and can withstand temperature ranges: from −60° C. to 230° C. (−76° F. to 446° F.). Silicone sponge 100 can easily break up and lifts away grease and surface debris deposited on grill grates 280.

Referring to FIGS. 2, 5, 8 and 9, respectively the cleaning tool includes an aluminum oxide sponge 270 and the aluminum oxide is coated over an impermeable sponge. Aluminum oxide sponge 270 a closed cell sponge; wherein each of the grooves in the grooved sponge comprise wrap around grooves for wrapping onto a top and sides of a corresponding bar of the cooking grate 280; and wherein the closed cell sponge include liquid permeable channels therein for liquid permeability. The grooved shape sponge is designed to promote effective rinsing as well as removal of remaining deposits on grate 280. The aluminum oxide sponge 270 could be used when the grill is cold or hot and is insoluble in a water boiling point of: 5391° F. (2977° C.).

Figure 14:
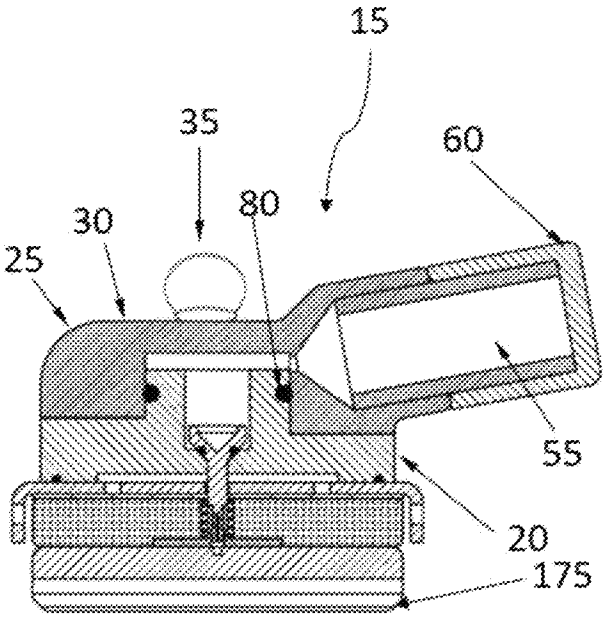
FIG. 14 is a side partial cross-sectional view of another embodiment of the disclosed cleaning tool from FIG. 1.
Figure 15:
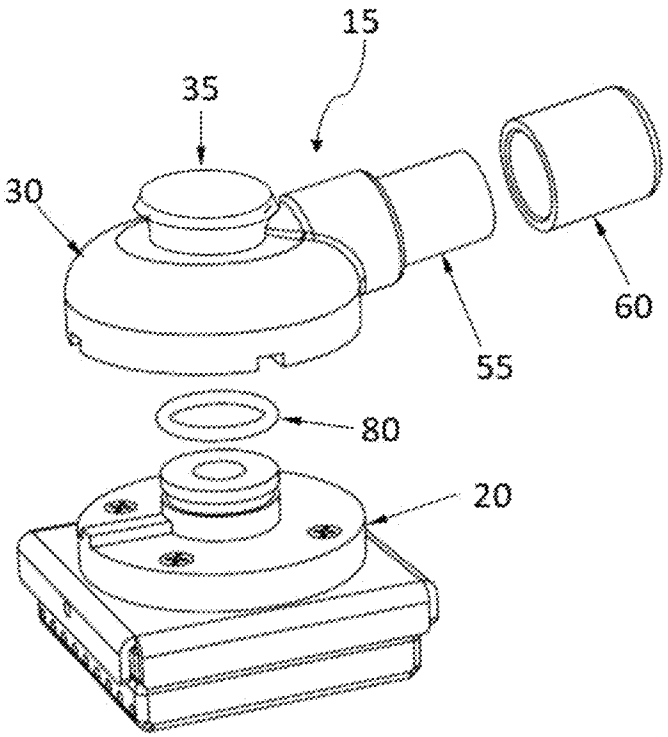
FIG. 15 is an exploded view of the cleaning tool from FIG. 14.

FIGS. 14 and 15 shows an alternate cleaning tool 15, as referenced in FIG. 1 above and does not include a handle member that extends from the end of the brush where fluid enters the reservoir. A fluid reservoir 55 is located within cavity 27 of the brush head 25 and a reservoir cap 60 is attached to the end of brush head 25 opening. The reservoir cap 60 can have an optional pinhole opening through which air vents. The brush head is configured with a valve mechanism used to regulate the flow of fluid within the orifices communicated between the integrated reservoir and intermediate sponge layer 110. The cleaning tool is designed to be used on cool surfaces and provides interchangeable scrubbing brushes 170 suited for grate cleaning for different types of surfaces. The application of this cleaning tool is not as effective as using the heating means to clean the grill.

Figure 16:
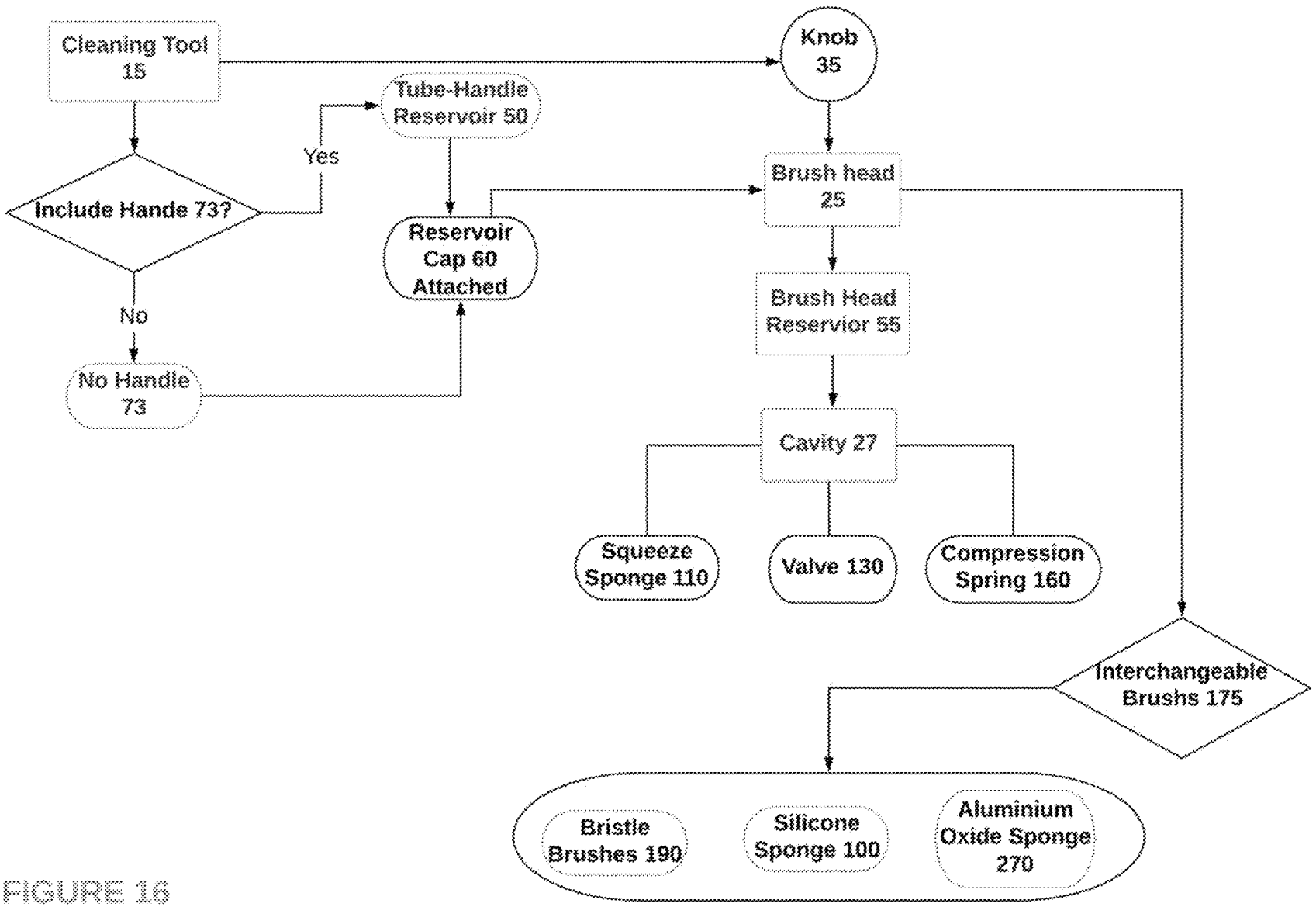
FIG. 16 is a flowchart illustrating a method of a manually cleaning grills and using a cleaning tool disclosed in FIG. 1 to FIG. 15.

Referring to FIG. 16, a method for manually cleaning grills using a cleaning tool 15 is illustrated in a flowchart. The method includes: a cleaning tool 15, as illustrated in FIGS. 1 to 15, with an elongated handle integrated with a tube-handle reservoir 50 or a brush head 25 with a removable handle 73; a squeeze sponge 110; a reservoir cap 60 attached to close the opening where fluid enters the brush head reservoir 55 and resides in the cavity 27; a valve 130 and compression spring 160 mechanism and removable scrubbing brushes 175. The reservoir cap 60 can have an optional pinhole opening through which air vents.

Figure 17:
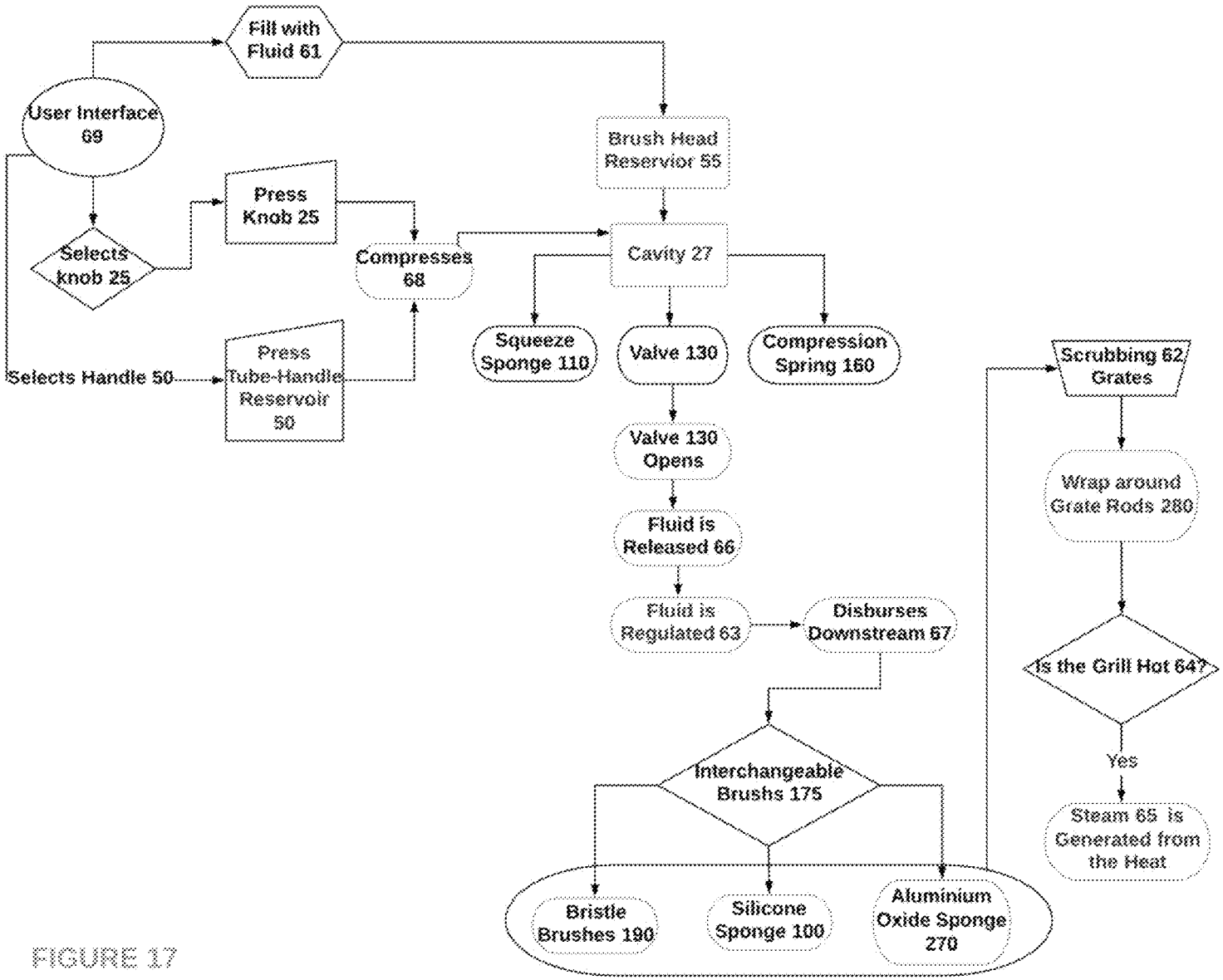
FIG. 17 is a flowchart is a continuation of FIG. 16 illustrating a user interface applying a method for manually cleaning grills and using a cleaning disclosed in FIG. 1 and FIG. 14.

The cleaning tool 15 is crafted to interface with the user as illustrated in the flowcharts of FIG. 16 and FIG. 17. Before cleaning as part of the user interface 69 the user fills the brush head reservoir 55 with an acidic solution or natural food grade cleaning acidic solution 61. The natural food grade cleaning acidic solution added to the reservoir can be lemon juice in alternative implantations. While scrubbing 62, the user places the brush on the grates 280 and moves the brush frontward and backwards in parallel to the grate rods 280. When the brush head 25 is pressed down from the knob 25 or tube-handle reservoir 25 during operation, the cleaning tool 15 flexes and compresses 68 the squeeze sponge 110, compression spring 160 to open the valve 130. The user 72 has the ability to regulate the flow of fluid within the orifices communicated between the brush head reservoir 60, intermediate sponge layer 110 and valve 130 mechanism. Fluid is regulated 63 by the amount of force exerted downward on the knob 35 or tube-handle reservoir 50 by the user. The valve remains closed and upon activation, fluid is released 66 to the squeeze sponge 110 which wicks fluid drawn from reservoir disbursed downstream 67 onto the surface of the scrubbing brushes 175 and hot 64 surface of the grates, generating the steam 65 to effectively remove the residue. The scrubbing brushes 175 are designed and formed to scrub 62 and wrap around grooves for wrapping onto a top and sides of a corresponding bar of the cooking grate 280 in the direction intended. Conversely, the grill can be cleaned when the grill is not heated, but the cleaning method is not as effective as steam cleaning.

Any letter designations such as (a) or (b) etc. used to label steps of any of the method claims herein are step headers applied for reading convenience and are not to be used in interpreting an order or process sequence of claimed method steps. Any method claims that recite a particular order or process sequence will do so using the words of their text, not the letter designations.

Unless stated otherwise, terms such as "first" and "second" are used to arbitrarily distinguish between the elements such terms describe. Thus, these terms are not necessarily intended to indicate temporal or other prioritization of such elements.

Any trademarks listed herein are the property of their respective owners, and reference herein to such trademarks is generally intended to indicate the source of a particular product or service.

Although the inventions have been described and illustrated in the above description and drawings, it is understood that this description is by example only, and that numerous changes and modifications can be made by those skilled in the art without departing from the true spirit and scope of the inventions. Although the examples in the drawings depict only example constructions and embodiments, alternate embodiments are available given the teachings of the present patent disclosure.

What is claimed is:

1. A cleaning tool, comprising:

a reservoir for holding a cleaning fluid;

a heat tolerant liquid permeable material on an outside surface of the tool and secured beneath the reservoir to receive the cleaning liquid, the heat tolerant liquid permeable material capable of withstanding a temperature above 212 F (100 C);

a handle secured to the reservoir for scrubbing with the heat tolerant liquid permeable material when wet from the cleaning fluid dispensed from the reservoir; and an absorptive liquid permeable material having an absorptive characteristic exceeding an adsorptive characteristic of the heat tolerant liquid permeable material, the absorptive material intermediately disposed between the reservoir and the heat tolerant liquid permeable material to hold and transport the cleaning liquid from the reservoir to the heat tolerant liquid permeable material; and wherein the heat tolerant liquid permeable material comprises a heat tolerant liquid permeable sponge and wherein the sponge comprises a grooved sponge on a lower side with rows of grooves arranged in parallel and spaced distances conforming to a cooking grate.

2. A cleaning tool according to claim 1, wherein the absorptive material is a compressible material disposed between the reservoir and the heat tolerant liquid permeable material in a configuration capable of squeezing the cleaning liquid from the absorptive liquid permeable material when force from above on a side near the reservoir is applied on the compressible material.

3. A cleaning tool according to claim 1, wherein the absorptive liquid permeable material comprises an open cell sponge.

4. A cleaning tool according to claim 1, wherein the heat tolerant liquid permeable sponge comprises a closed cell sponge.

5. A cleaning tool according to claim 4, wherein the closed cell sponge has liquid permeable channels formed therein for liquid permeability.

6. A cleaning tool according to claim 1, wherein each of the grooves in the grooved sponge comprise wrap around grooves for wrapping onto a top and sides of a corresponding bar of the cooking grate.

7. A cleaning tool according to claim 1, wherein the heat tolerant liquid permeable sponge comprises an aluminum oxide sponge.

8. A cleaning tool according to claim 1, wherein the heat tolerant liquid permeable sponge comprises a aluminum oxide sponge capable of withstanding up to 5391 F (2977 C).

9. A cleaning tool according to claim 1, wherein the heat tolerant liquid permeable sponge comprises a silicone sponge.

10. A cleaning tool according to claim 1, wherein the handle is a knob above the reservoir.

11. A cleaning tool according to claim 1, wherein the handle is an elongated handle.

12. A cleaning tool according to claim 1, wherein the heat tolerant liquid permeable sponge has pinholes bored therethrough.

13. A method of cleaning a hot grate comprising the steps of:

(a) obtaining the cleaning tool, the cleaning tool comprising:

a reservoir for holding a cleaning fluid;

a heat tolerant liquid permeable material on an outside surface of the tool and secured beneath the reservoir to receive the cleaning liquid, the heat tolerant liquid permeable material capable of withstanding a temperature above 212 F (100 C);

a handle secured to the reservoir for scrubbing with the heat tolerant liquid permeable material when wet from the cleaning fluid dispensed from the reservoir; and an absorptive liquid permeable material having an absorptive characteristic exceeding an adsorptive characteristic of the heat tolerant liquid permeable material, the absorptive material intermediately disposed between the reservoir and the heat tolerant liquid permeable material to hold and transport the cleaning liquid from the reservoir to the heat tolerant liquid permeable material;

(b) filling the reservoir with the cleaning fluid;

(c) wetting the absorptive liquid permeable material from the reservoir with the cleaning liquid;

(d) wetting the heat tolerant liquid permeable material on an outside surface of the tool; and (e) scrubbing the hot grate with the heat tolerant liquid permeable material using the handle secured near the reservoir when wetting in said steps (c) and (d) with the cleaning fluid from the reservoir; and (f) applying a downward force from the reservoir against a top of the absorptive material to squeeze the cleaning liquid from the absorptive liquid permeable material.

14. A method of cleaning a hot grate according to claim 13, wherein said step (a) of obtaining the cleaning tool comprises the substep of (a)(1) obtaining the cleaning tool wherein the heat tolerant liquid permeable material comprises a heat tolerant brush.

15. A method of cleaning a hot grate according to claim 14, wherein said step (a) of obtaining the cleaning tool comprises the substep of (a)(2) obtaining the cleaning tool wherein the heat tolerant brush comprises a wire brush.

16. A method of cleaning a hot grate according to claim 13, wherein said step (a) of obtaining the cleaning tool comprises the substep of (a)(1) obtaining the cleaning tool wherein the heat tolerant liquid permeable material comprises a heat tolerant liquid permeable sponge.

17. A method of cleaning a hot grate according to claim 16, wherein said step (a) of obtaining the cleaning tool comprises the substep of (a)(2) obtaining the cleaning tool wherein the heat tolerant liquid permeable sponge comprises an aluminum oxide sponge.

18. A method of cleaning a hot grate according to claim 13, wherein said step (a) of obtaining the cleaning tool comprises the substep of (a)(1) obtaining the cleaning tool wherein the heat tolerant liquid permeable material has an aluminum oxide coating.

19. A method of cleaning a hot grate according to claim 18, wherein said step (a) of obtaining the cleaning tool comprises the substep of (a)(2) obtaining the cleaning tool wherein the heat tolerant liquid permeable material has pinholes bored therethrough.

20. A cleaning tool according to claim 12, wherein the heat tolerant liquid permeable sponge has an aluminum oxide coating.

* * * * *